United States Patent [19]

Feuerlein

[11] 4,031,679

[45] June 28, 1977

[54] SPHERICAL STORAGE TANK FOR GASES AND LIQUIDS AND SUPPORTING BASE THEREFOR

[75] Inventor: Peter Feuerlein, Pratteln, Switzerland

[73] Assignee: Buss Aktiengesellschaft, Basel, Switzerland

[22] Filed: Oct. 8, 1976

[21] Appl. No.: 730,862

[30] Foreign Application Priority Data

Nov. 5, 1975 Switzerland ..... 14466/75

[52] U.S. Cl. ..... 52/294; 52/167; 220/3

[51] Int. Cl.[2] ..... E02D 27/32

[58] Field of Search ..... 52/294, 295, 403, 404, 52/167; 220/3, 5; 61/50

[56] References Cited

UNITED STATES PATENTS 3,606,715 9/1971 Wyss et al. ..... 52/294

FOREIGN PATENTS OR APPLICATIONS 1,928,205 12/1970 Germany ..... 52/294

1,182,609 11/1964 Germany ..... 52/294

*Primary Examiner*—J. Karl Bell

[57] ABSTRACT

A mounting for a spherical tank holding gases or liquids which is supported on a rigid concrete foundation in a region of the vertical axis of the tank, the mounting consisting essentially of a spaced array of rigid support elements of foamed or sponge structure, such as foam glass blocks within a matrix of light heat insulating filler such as a mixture on the basis of polyurethane. The upper and the lower surfaces of the array of support elements and matrix are coated with an elastic layer, which are bonded to the steel surface of the tank and to the top of the foundation. The upper elastic layer may consist of felted fine gauge aluminium wire, while the lower elastic layer may consist of felted mineral fibres.

5 Claims, 3 Drawing Figures

SPHERICAL STORAGE TANK FOR GASES AND LIQUIDS AND SUPPORTING BASE THEREFOR

This invention provides a spherical tank for gases and liquids resting on a foundation in the region of the vertical axis of the spherical shell of the tank, there being interposed between the foundation and the spherical shell a mounting, having generally elastic properties and being adhesively bonded to the spherical shell of the tank and to the foundation.

This invention relates to a spherical storage tank for gases and liquids and a supporting base therefor. Conventionally spherical tanks are supported by lateral struts attached to the external periphery of the shell of the tank. This method of support is open to the objection that changes in the quantity of fluid contained in the tank tend to cause uncontrollable stresses at the connecting points of the struts. Fractures and possibly even the destruction of the tank may ensue. Moreover, in some parts of the world the occurence of earth tremors at irregular intervals presents special problems. In such circumstances costly and technically complex precautionary measures must be taken for dealing with the above-mentioned difficulty or the use of spherical tanks may have to be abandoned altogether.

For overcoming these difficulties it has already been proposed to rest the spherical shell of the tank on a specially prepared gravel bed or on a concrete foundation with or without the interposition of a cushioning layer. U.S. Pat. No. 3,606,715 for example describes a spherical storage tank and supporting base therefor with a mounting interposed between the tank and the foundation consisting of a material with elastomeric properties and being solidly bonded both to the tank and to the foundation. The construction according to the said Patent provides a mounting wherein there is interposed between the foundation and the spherical shell a plurality of compressible supports having a cellular configuration and consisting of an elastomeric material of good compressive properties, and a flexibly elastic composition pressed into interstitial spaces formed between the compressible supports, said supports and said composition being adhesively bonded by a bonding layer to the shell of the spherical tank and to the foundation.

The combination, as described above, results in an orthotrope transfer of the load and at the same time the bottom of the sphere is effectively isolated from the foundation preventing electrolytic corrosion. This construction has been made use of successfully meanwhile and offers many advantages.

But it is considered a drawback, that this support method was not as such applicable for temperatures lower than 50° centigrade. But, in practice, for example liquefied ethylene has to be stored at about minus 100° C. Elastomeric or plastic materials become stiff and rigid at such low temperatures and can no longer transfer the load in the required manner.

Furthermore, the support layer should have thermal insulating properties to reduce losses of cold and prevent or minimize the cooling of the foundation.

The object of the present invention is to overcome the above-described difficulties and to provide a spherical tank and a foundation therefor which is well suited to store, e.g. liquefied gases or liquids at very low temperatures with minimal losses and which simultaneously saves all the advantages gained with the construction previously described.

This object is attained according to the present invention by the provision of a spherical tank for gases and liquids which rests on a foundation in the region of the vertical axis of the spherical shell of the tank, there being interposed between the foundation and the spherical shell a mounting comprising a plurality of rigid support elements having a cellular or foamed configuration and a light foamed heat-insulating composition pressed into interstitial spaces formed between the rigid support elements, said support elements and said composition being covered at its top and bottom each by an elastic layer capable of being exposed to very low temperatures without becoming stiff, said mounting being adhesively bonded by a bonding layers to the shell of the spherical tank and to the foundation.

The means thus interposed between the spherical tank and the foundation save the advantage, known from previously known constructions, to transmit the load vertically to the foundation and at the same time to admit of compensating horizontal motion without actual displacement, but simultaneously provides for an excellent heat insulation between spherical tank and foundation.

Useful elastic covering layers consist for the upper one of felted aluminium wires, impregnated and sealed against diffusion of humidity, and for the lower one of mineral fibers.

It is furthermore useful for the support elements to be of rigid foam-glass in an array and to fill the interstices with a light foam based on polyurethanes. The foundation itself should be channeled to facilitate temperature equilibration with the surrounding air.

To conclude it is recommended to surround the brim of the top of the foundation with a flexible gasket to facilitate the injection of the foamable insulation.

The invention will now be described by way of example and with reference to the accompanying drawings, in which.

Figure 1:
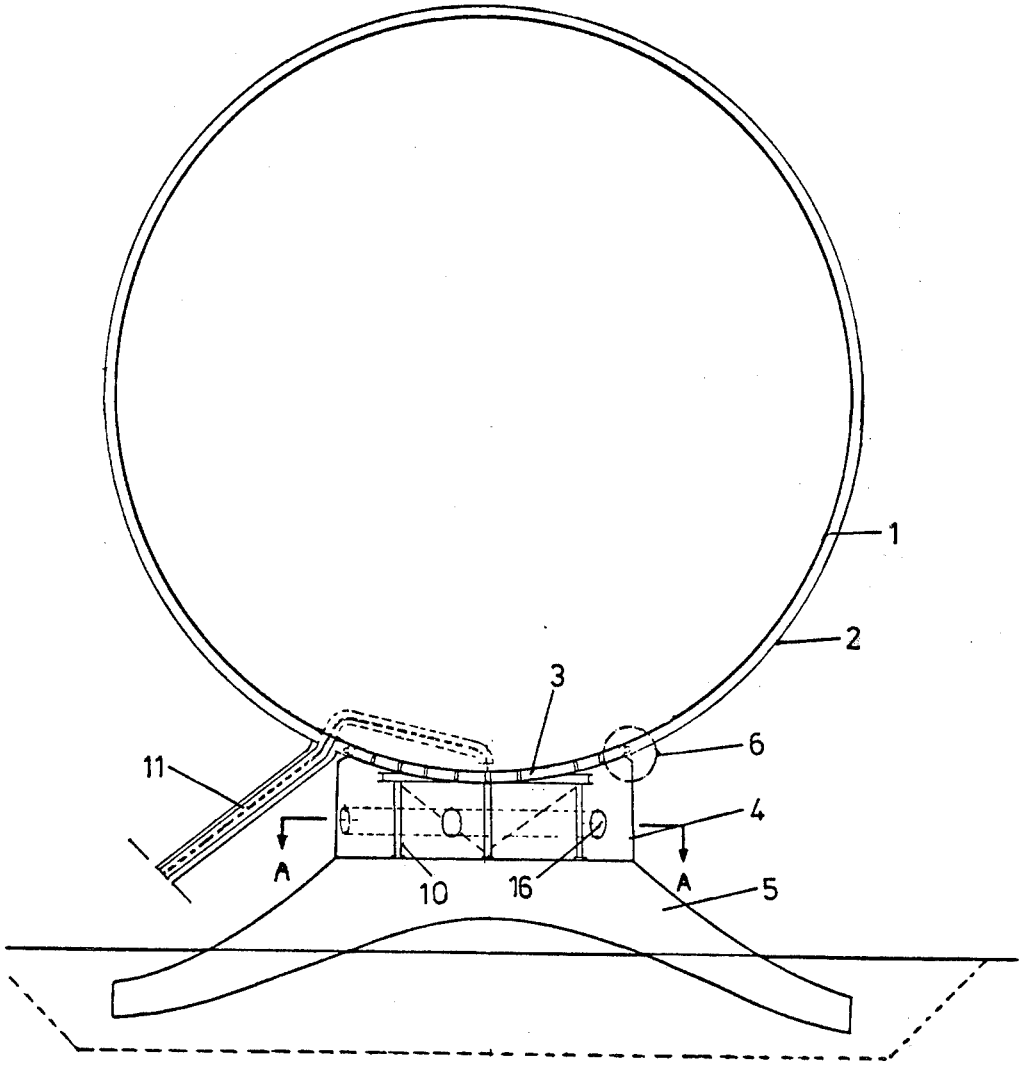
FIG. 1 is a vertical section through a spherical tank with support and foundation.
Figure 2:
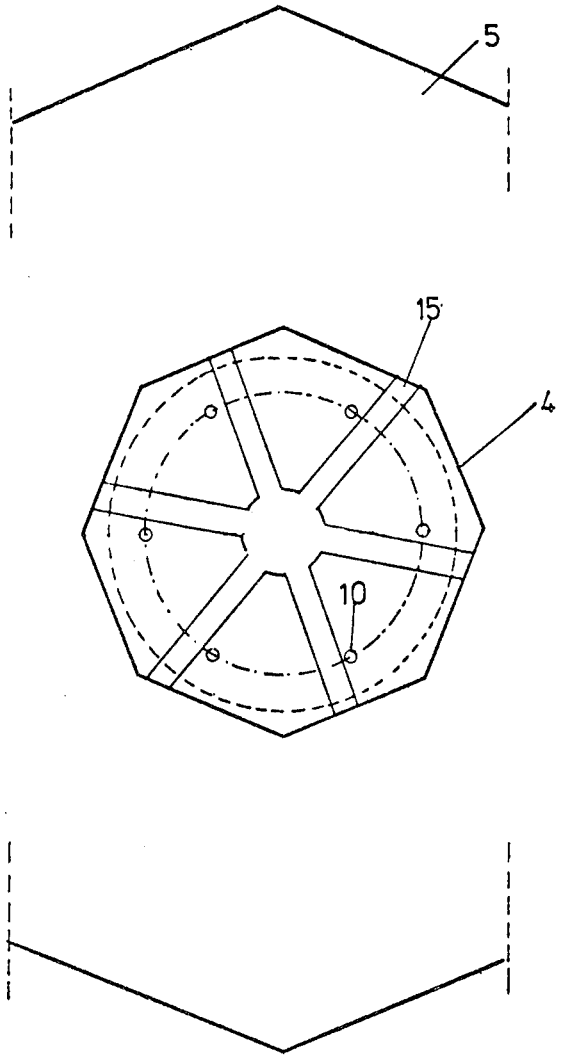
FIG. 2 is a section on line A—A of FIG. 1

In the example the support in FIG. 1 shows a spherical tank 1, used for storage of gases or liquids at low temperatures, mostly at below minus 50° C. The tank is covered with an insulating layer 2 to prevent cold losses and is placed on a concrete foundation, divided in a pedestal 4 and a base 5. The surface of the pedestal 4 is cased with a shell of sheet steel 9. On this casing 9 there is bonded with a cold resistant adhesive 7 a support mounting 3 which includes two mats 12 and 13 of built-up fibering. Inbetween the mats 12 and 13 are placed rigid support elements 14 in an array and with the interstices filled by foaming-in a heat insulating material 15. In this example the upper mat 12, bonded to the spherical tank, consists of felted fine-gauge aluminium wire, which has good mechanical resistance even at low temperatures and is impregnated and sealed against diffusion of humidity. The bottom mat 13 is built-up in an analogeous manner of mineral fiber. The support elements 14 consist of pressure resistant blocks of foam-glass having high thermal insulating value. The interstices are filled up with heat insulation 15 by foaming-in a light mixture based on polyurethane, limited at the rim of the pedestal 4 by a gasket ring 17.

Figure 3:
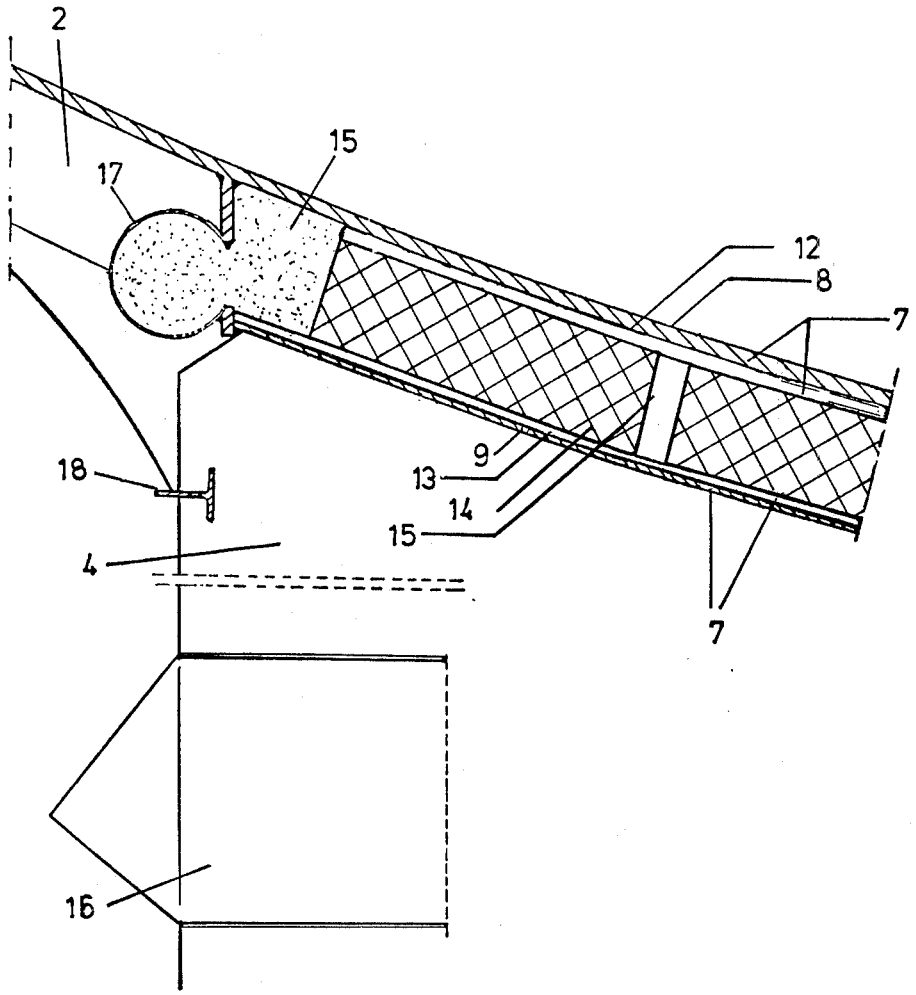
FIG. 3 is the pos. 6 of FIG. 1 enlarged.

The construction of the mounting 3, interposed between the spherical tank 1 and the foundation 4, 5, can best be seen in FIG. 3. The mounting 3 consists essentially of a plurality of foam-glass blocks 14 arranged in a spaced array, the interstices being filled-up with a light, foamed insulating material 15 on the basis of polyurethane. This central layer is sandwiched by an upper elastic layer 12 and by a lower elastic layer 13. While the upper layer 12 consists of felted fine-gauge aluminium wire, impregnated and sealed against humidity, the lower layer 13 is built up of felted mineral fibres. The top surface of the upper layer 12 is covered by an adhesive layer 7 to be solidely bonded to the wall 8 of the spherical tank 1, while the lower surface of layer 12 is bonded, by means of an adhesive layer 7, to the upper surface of the central layer consisting of blocks 14 and heat insulating material 15. Correspondingly, the lower elastic layer 13 is bonded, by means of an adhesive layer 7, to the lower surface of the central layer, while a further adhesive layer 7 is provided at the lower surface of layer 13 to bond the latter to the steel shell 9.

When constructing, the foundation base 5 is cast first in form of an inverted cup and then a support framework 10 is erected to assist the assembly of the support layer 3 to the spherical tank 1. After filling the interstices by foaming-in the heat insulation 15, concrete is cast around the framework 10 to form the pedestal 4, which can be provided with wide air-channels to facilitate the temperature exchange with the surrounding air. A pipe 11 is also shown serving for filling and discharge of the spherical tank and being heat insulated as well.

The combination just described of a cold resistant adhesive 7, elastically deformable mats 12 and 13, rigid support elements 14 in a spaced array and the filling of the interstices with hardened foam, results in a favourable transfer of the load to the concrete foundation. The bottom of the sphere is effectively isolated from the foundation by the heat insulating mounting.

I claim as my invention:

1. In combination, a spherical tank for gases and liquids, a rigid load-bearing concrete foundation in the region of the vertical axis of said spherical tank, and a mounting interposed between said foundation and the underside of said spherical tank, said mounting having generally elastomeric properties and being solidly bonded to the underside of said spherical tank and to said foundation, said mounting consisting essentially of a plurality of rigid support elements in spaced array within a matrix of foamed heat insulation material, the upper and the lower surface of said plurality of said rigid support elements being covered by elastic layers of a material remaining elastic even at very low temperatures, a load bearing steel shell interposed between said concrete foundation and the lower of said elastic layers, and a first adhesive bonding layer between the underside of said spherical tank and the top of the upper of said elastic layers, a second adhesive bonding layer between the bottom of the upper of said elastic layers and the top of said plurality of rigid support elements, a third adhesive bonding layer between the bottom of said plurality of rigid support elements and the top of the lower of said elastic layers, and a fourth adhesive bonding layer between the bottom of the lower of said elastic layers and the top of said steel shell, said mounting assuring orthotropic transmission of the load of said tank to the foundation and insulating the tank from the foundation to prevent heat losses.

2. The combination as claimed in claim 1 wherein said rigid support elements are rigid foam-glass blocks having a high thermal insulating value and said foamed heat insulating material between said rigid support elements is a light mixture on the basis of polyurethane.

3. The combination as claimed in claim 1 wherein the upper of said elastic layers consists of felted fine-gauge aluminium wire which is impregnated and sealed against diffusion of humidity, and the lower of said elastic layers consisting of felted mineral fibres.

4. The combination as claimed in claim 1 wherein said concrete foundation comprises air channels to facilitate temperature equilibration with the surrounding air.

5. The combination as claimed in claim 1 wherein there is provided a circular, flexible gasket means surrounding said mounting and being fixed to the underside of said spherical tank and to the top of said concrete foundation to prevent said heat insulating material of escaping when it is foamed-in.

* * * * *